US006580744B1

(12) United States Patent
Irnich

(10) Patent No.: US 6,580,744 B1
(45) Date of Patent: Jun. 17, 2003

(54) FEED DEVICE FOR A SHAFT FURNACE

(75) Inventor: Franz-Josef Irnich, Hürtgenwald (DE)

(73) Assignee: Zimmermann & Jansen GmbH, Duren (DE)

( * ) Notice: Subject to any disclaimer, the term of this patent is extended or adjusted under 35 U.S.C. 154(b) by 0 days.

(21) Appl. No.: 10/018,925

(22) PCT Filed: Jun. 23, 2000

(86) PCT No.: PCT/EP00/05798

§ 371 (c)(1),
(2), (4) Date: Dec. 19, 2001

(87) PCT Pub. No.: WO01/00884

PCT Pub. Date: Jan. 4, 2001

(30) Foreign Application Priority Data

Jun. 25, 1999 (DE) ..... 199 29 180

(51) Int. Cl.[7] ..... F27D 3/00
(52) U.S. Cl. ..... 373/79; 414/206
(58) Field of Search ..... 373/78–82; 266/176, 266/183, 197, 199; 414/167–170, 195, 200–206, 208, 221, 292, 301; 193/16; 198/642

(56) References Cited

U.S. PATENT DOCUMENTS 2,753,056 A * 7/1956 Eastman et al. ..... 414/206
3,799,368 A * 3/1974 Wieczorek ..... 414/206
4,243,351 A * 1/1981 Legille et al. ..... 414/206
5,799,777 A * 9/1998 Mailliet et al. ..... 414/208
6,389,054 B1 * 5/2002 Stercho ..... 373/79

FOREIGN PATENT DOCUMENTS

DE 2825718 A1 * 1/1979
JP 63-96205 * 4/1988
JP 6-145731 * 5/1994

* cited by examiner

*Primary Examiner*—Tu Ba Hoang
(74) *Attorney, Agent, or Firm*—Andrus, Sceales, Starke & Sawall, LLP

(57) ABSTRACT

Feed device (100) for a shaft furnace (101), with a revolving chute (107, 111) comprising a cylindrical basic body (107) that can be driven so as to rotate about a first, substantially vertically oriented axis of rotation (A1) with a first drive mechanism (119) and a feed chute (111) that is fixedly attached to an outlet (107*a*) of the basic body and can be rotated therewith, in which the feed chute is composed of an upper part (113), which is adjacent to the outlet of the basic body and extends longitudinally at an angle to the first axis of rotation, and a lower part (115), which is rotatably connected to the upper part and comprises a second drive mechanism (127) for rotation about a second, substantially vertical axis of rotation (A2) spaced apart from the first axis of rotation.

16 Claims, 8 Drawing Sheets

FEED DEVICE FOR A SHAFT FURNACE

CROSS REFERENCE TO RELATED APPLICATION

The present application is the U.S. national stage application of International Application PCT/EP00/05798, filed Jun. 23, 2000, which international application was published on Jan. 4, 2001 as International Publication WO 00/00884 A1 in the English language. The International Application claims priority of German Patent Application 199 29 180.2, filed Jun. 25, 1999.

DESCRIPTION

The invention relates to a feed device for a shaft furnace, in particular a blast furnacer, according to the precharacterizing clause of Claim 1.

Many different devices are known for the purpose of feeding materials into (i.e., charging) a shaft furnace. So that the materials fed in are uniformly distributed over the cross-sectional area of the shaft, decades ago it was proposed to use rotatable charging platforms with a likewise rotatable distributor disposed eccentrically with respect to the axis of the furnace. With such a feed device, which causes the opening of the distributor to be guidedover the furnace cross section along two superimposed arcs, the material can be fed into the furnace quite uniformly, without the formation of obvious conical heaps.

A somewhat different arrangement, such as is known from the German patent DE 295 15 419 U1, comprises a revolving chute with a cylindrical housing that can be driven so as to rotate, multiple feed chutes attached to the outlet of the housing, which have different radial extents, and a distributor chute disposed in the housing, the end of which opens into a feed chute and can be rotated with the housing, such that the distributor chute can be displaced within the housing and variably positioned with respect to the feed chutes, as desired. With this arrangement the profile of the loaded substance can be made to conform to a specific shape, but the apparatus is relatively complicated and costly to construct.

The patent DE-PS 868913 discloses variously shaped charging devices for blast furnaces, the central element of which is a first funnel with a proboscis-shaped outlet, through which passes the material that is to be brought to the edge of the furnace, and a second funnel with vertical outlet, which guides the material to the middle of the furnace. This arrangement, again, is characterized by an expensive and bulky construction, and furthermore it is only to a very limited extent that it allows different materials to be loaded so as to form a particular, desired profile.

Another rotatable feed device, known from DE-AS 1 169 474, comprises a plurality of distributor chutes distributed around the circumference of a circle, and in addition a nearly central and a peripheral distributor chute, all of which are filled by a suitably guided funnel chute. In this arrangement the position of the opening at an arbitrary point on the shaft cross section cannot be freely adjusted, and this device again is complicated and costly to construct.

From DE 28 25 718 C2 and other patents of the same proprietor a feed device for a shaft furnace is known, the central feature of which is a distributor chute with a universal-joint suspension, which can be positioned at various angles with respect to the axis of the furnace, by using a suitable mechanism to rotate it about two axes that are perpendicular to one another. This device makes it possible for materials to be fed into the shaft at well defined positions over its cross section, but its drive mechanism is structurally elaborate and space-consuming.

It is thus the objective of the present invention to disclose an improved feed device of this generic kind which can be implemented in a particularly space- and material-saving manner.

This objective is achieved by a feed device with the characteristics given in Claim 1.

The invention includes the fundamental thought that a feed chute, oriented at an angle to the furnace wall, is fixedly attached to a central, rotatable base body. The chute is in turn divided into an upper and a lower part, the lower part being rotatable with respect to the upper part. Because in this solution only one feed chute (with relatively short overall length) is provided, it can be constructed from a particularly small amount of material. Furthermore, its pivoting mechanism is not under a heavy mechanical load, and hence need not be correspondingly stable in construction, nor does it require an extra, rotatable distributor device; therefore it is relatively easy to construct and takes up relatively little space.

In a preferred embodiment the upper and lower parts are substantially cylindrical in shape (tubular), in particular elliptical or semi elliptical, and when the lower part is in the appropriate angular position with respect to the upper part, the whole arrangement forms a two-piece tube attached at an angle to the outlet of the base body. This embodiment ensures that the pseudo-fluid substance to be fed into the furnace will run out unobstructed and with little friction.

The geometrical relationships are relatively simple when the axis of rotation of the lower part is parallel to the vertical axis of rotation of the base body, and both axes are perpendicular to the plane that separates the lower from the upper part (in which the movement of the lower part with respect to the upper part is guided).

The drive mechanism for the housing (and upper part) is advantageously implemented in a manner known per se, by an electric motor with a combination of pinion and toothed wheel rim, such that the pinion of the drive motor is engaged by a rim gear that is fixed to the base body in a rotationally stable manner. The drive mechanism for the lower part also, in an advantageous embodiment, comprises a combination of pinion and toothed wheel rim, and in this case the toothed rim in particular encloses the outlet of the base body. In a first advantageous embodiment there is attached to this latter toothed wheel a connecting-rod arrangement that is connected by he way of joints at one end to the wheel and by way of joints at the other end to the lower part of the feed chute.

In an alternative embodiment, the drive mechanism for the lower part of the feed chute comprises an output shaft, at the end of which that adjoins the lower part there is disposed a pinion that interacts with another toothed wheel rim that encloses the lower part in a rotationally stable manner.

Both the upper part and the lower part advantageously rotate over a range of angles amounting substantially to 360°.

With regard to enabling the loading profile to be predetermined in detail, the proposed solution is particularly advantageous in the embodiment with at least two reservoirs for a first and a second material to be fed in, which open into the base body of the feed device and either of which can be emptied into the base body as desired. Because the degree of opening of the retaining flap of the reservoir is determined by the current angles of rotation of the upper and lower part of the feed chute relative to one another, one or the other of the materials (or, where appropriate, other materials to be fed in) can be loaded in predetermined amounts at preselected places on the cross section of the shaft.

Such a differentiated feeding can be accomplished in an especially advantageous manner with an embodiment incorporating a feed-control unit that on the input side comprises means for determining the angular positions of the upper and lower parts (and hence the momentary feed point), whereas on the output side flap actuators for the outlet flaps of the reservoirs are disposed.

In a feed device in the broader sense, between the reservoir or reservoirs a valve arrangement is provided, which in a preferred embodiment comprises a flow-control valve and a gas-tight shut-off valve for each reservoir. This valve arrangement is advantageously designed as a compact valve assembly, which preferably can be displaced as a whole, together with the associated valve drive means, both with respect to the shaft furnace and with respect to the reservoir or reservoirs.

An inlet flange of the shaft furnace is preferably sealed with respect to a flange of the above-mentioned valve assembly that is in contact therewith, which can be achieved particularly reliably and permanently by using a compensator with a press-on device that compensates for thermal expansion. Such a device comprises a hydraulic press-on device or—as has been disclosed for example in the applicant's patent EP 0 609 406 B1—thermodynamic press-on devices.

Furthermore, a feed funnel is advantageously disposed between the reservoir or each reservoir and the valve assembly. At its outlet the flow-control valve associated with the above-mentioned valve arrangement is disposed, whereas at the outlet from each reservoir into the associated funnel an additional, gas-tight shut-off valve is disposed, which enables the substance to be filled into the funnel without making contact with the sealing surfaces of the valve.

BRIEF DESCRIPTION OF THE DRAWINGS

Advantages and useful features of the invention will be evident from the subordinate claims and from the following description of two exemplary embodiments with reference to the figures, wherein FIGS. 1*a,* 1*b* and 1*c* show a first embodiment of the feed device in accordance with the invention at a shaft furnace, in partial longitudinal section, in a partial cross-sectional view and in the form of an enlarged part of the partial longitudinal section, FIGS. 2*a,* 2*b* and 2*c* show a second embodiment of the feed device in accordance with the invention at a shaft furnace, in partial longitudinal section, in a partial cross-sectional view and in the form of an enlarged part of the partial longitudinal section.

DETAILED DESCRIPTION OF THE INVENTION

Figure 1A:
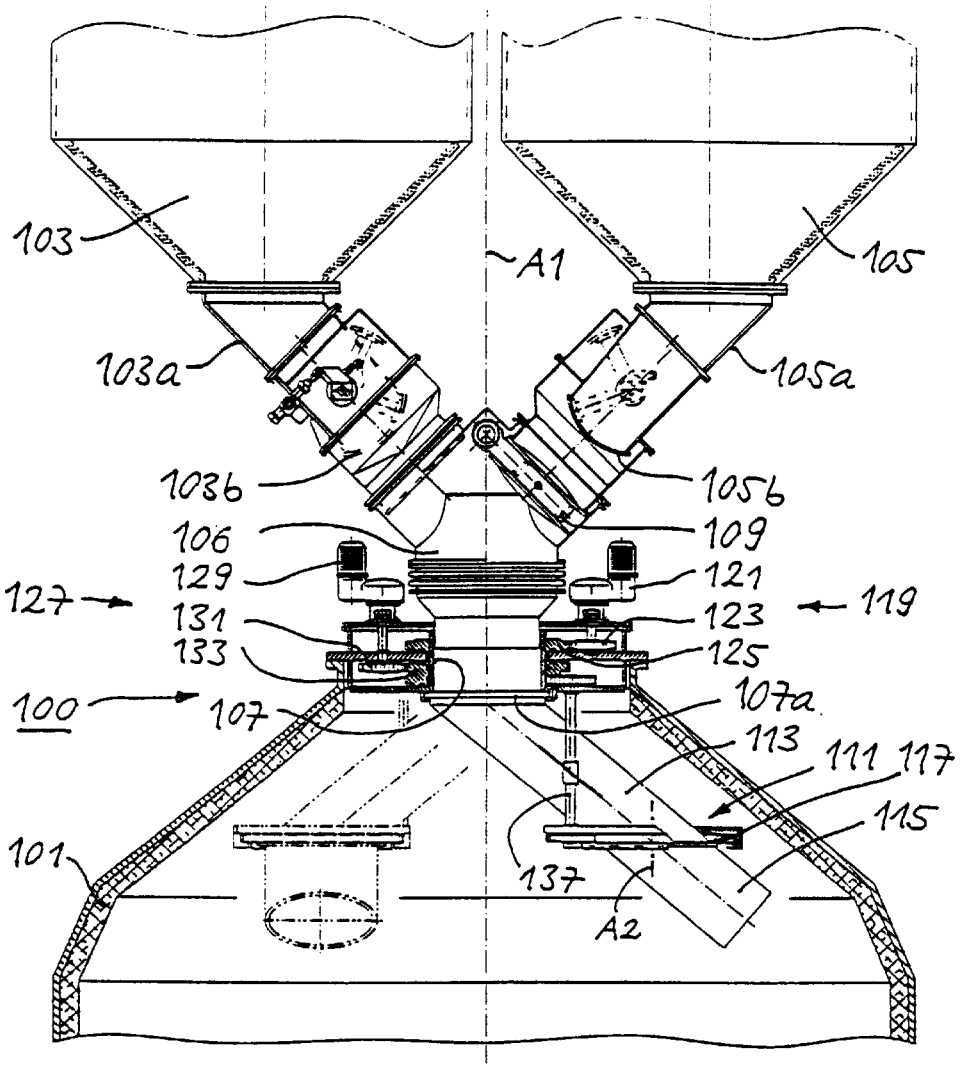
Figure 1B:
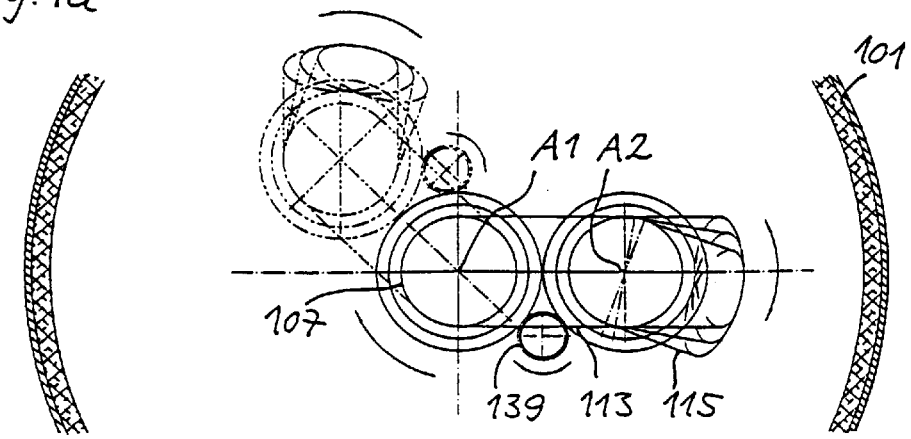
Figure 1C:
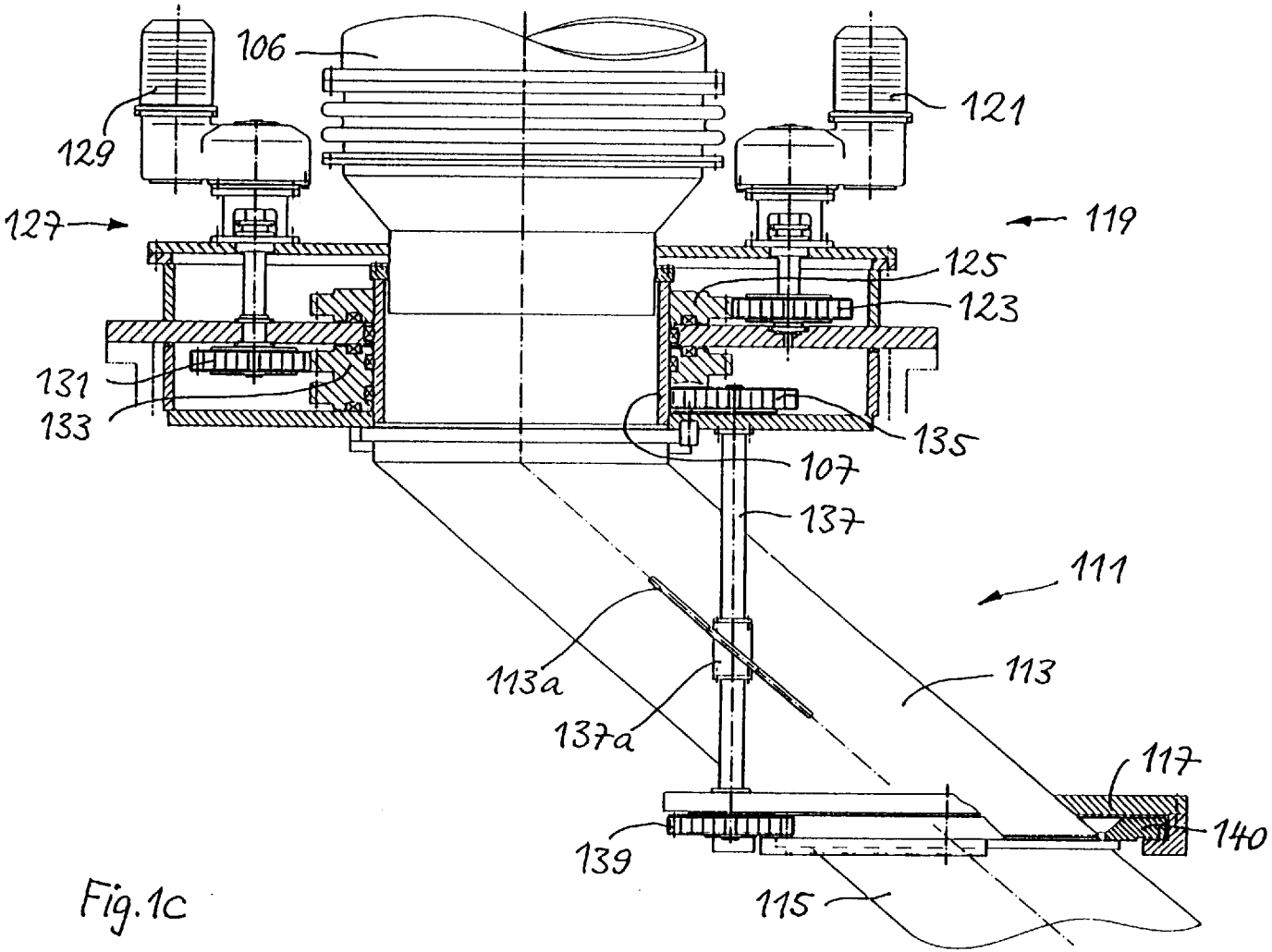

FIGS. 1*a* to 1*c* give various views of a feed device 100 for a blast furnace 101 according to a first embodiment of the invention. Above the feed device 100 are disposed a first and a second reservoir 103, 105 for a first and second kind of material to be fed in. Each reservoir comprises an outlet tube 103*a,* 105*a* that can be opened or kept shut, as desired, by a retaining flap 103*b,* 105*b.* The outlet tubes 103*a,* 105*a* open at right angles to one another into a feed funnel 106 for a basic body 107 of the feed device, within which a gas-tight flap 109 is disposed in such a way that it can be swivelled and thereby brought into contact with one or the other of the outlet tubes 103*a,* 105*a.* At the lower end face of the basic body 107, which simultaneously forms its outlet 107*a,* a feed chute 111 is flange-mounted.

The feed chute 111 comprises a tubular upper part 113, which is mounted at an angle to the outlet 107*a*, and a lower part 115, which is also tubular and has the same diameter as the upper part 113. The plane separating the upper part 113 from the lower part 115 is parallel to the plane of the outlet 107*a*, and a long axis (simultaneously the axis of rotation) A1 of the basic body 107 passes perpendicularly through that plane. At if this separation plane the upper part 113 and lower part 115 of the feed chute 111 are rotatably connected to one another by way of a bearing housing 117. The connection is designed such that the lower part 115 can be rotated about an axis A2 that is at an angle with respect to its long axis but parallel to and spaced apart from the first axis of rotation A1. In FIG. 1*a* the dot-dot-dashed lines indicate a second rotational position of the feed chute 111, in which the lower part has also been rotated so that its angle with respect to the upper part 113 is different from the angle shown for the chute position indicated by the solid lines. (In the interest of clarity, the drawing does not show reference numerals to identify the elements in this second position.)

The basic body 107 is provided with a first drive mechanism 119, which comprises a first electric motor 121 with a first driving pinion 123 as well as a toothed wheel rim that is fixedly attached to the wall of the basic body 107. Connected to the feed chute 111 is a second drive mechanism 127, which comprises a second electric motor 129, a second driving pinion 131 and a second toothed wheel rim 133 so mounted that it can be rotated relative to the basic body 107. Additional elements belonging to the second drive mechanism 127 are an output shaft 137, which engages the toothed wheel rim 133 by way of another pinion 135 and at its end adjacent to the lower part 115 bears another pinion 139, which engages a toothed wheel rim 141 that is non-rotatably attached to the lower part 115 of the feed chute. The output shaft 137 is held against the upper part 113 of the feed chute by way of a bearing bush 137*a* and a clasp 113*a.*

After opening of one or both retaining flaps 103*b*, 105*b*, materials contained in the reservoirs 103, 105 pass through the feed funnel 106, the basic body 107 and the feed chute 111, arriving at a place in the interior of the blast furnace 101 that is determined, firstly, by the angular orientation of the basic body 107 and the upper part 113 of the feed chute attached thereto, and secondly by the angular orientation of the lower part 115 of the feed chute relative to the upper part 113, as indicated by the superimposed representations of some of the possible positions in FIG. 1*b.* By actuation of the drive mechanisms 119 and 127 (the control of which is explained in more detail below), on one hand the angular orientation of the housing 107 and hence of the upper part 113 is adjusted with respect to the axis of rotation A1, and on the other hand the angular orientation of the lower part 115 is adjusted with respect to the axis of rotation A2. The drive mechanisms 119, 127 can each operate alone—i.e., while the other is not in motion—or they can be in operation together, in which case they can run synchronously or asynchronously with respect to one another. As a result, there are many possible ways to control the amount of the first and/or second material that is fed into the interior of the blast furnace 101 at predetermined places.

Figure 2A:
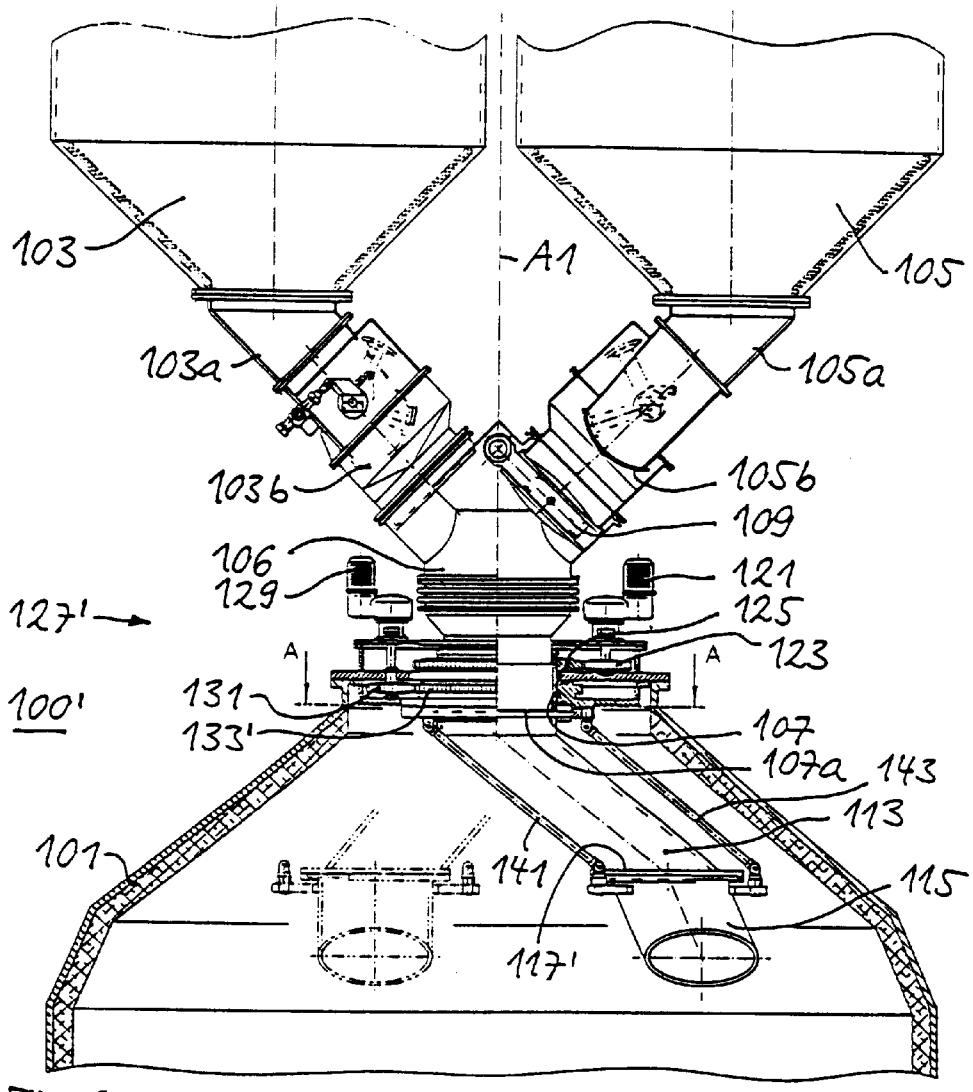
Figure 2B:
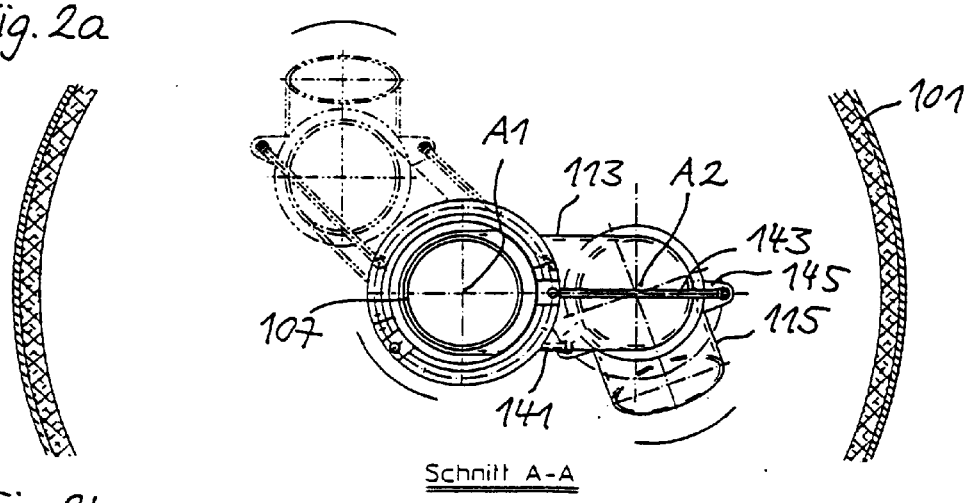
Figure 2C:
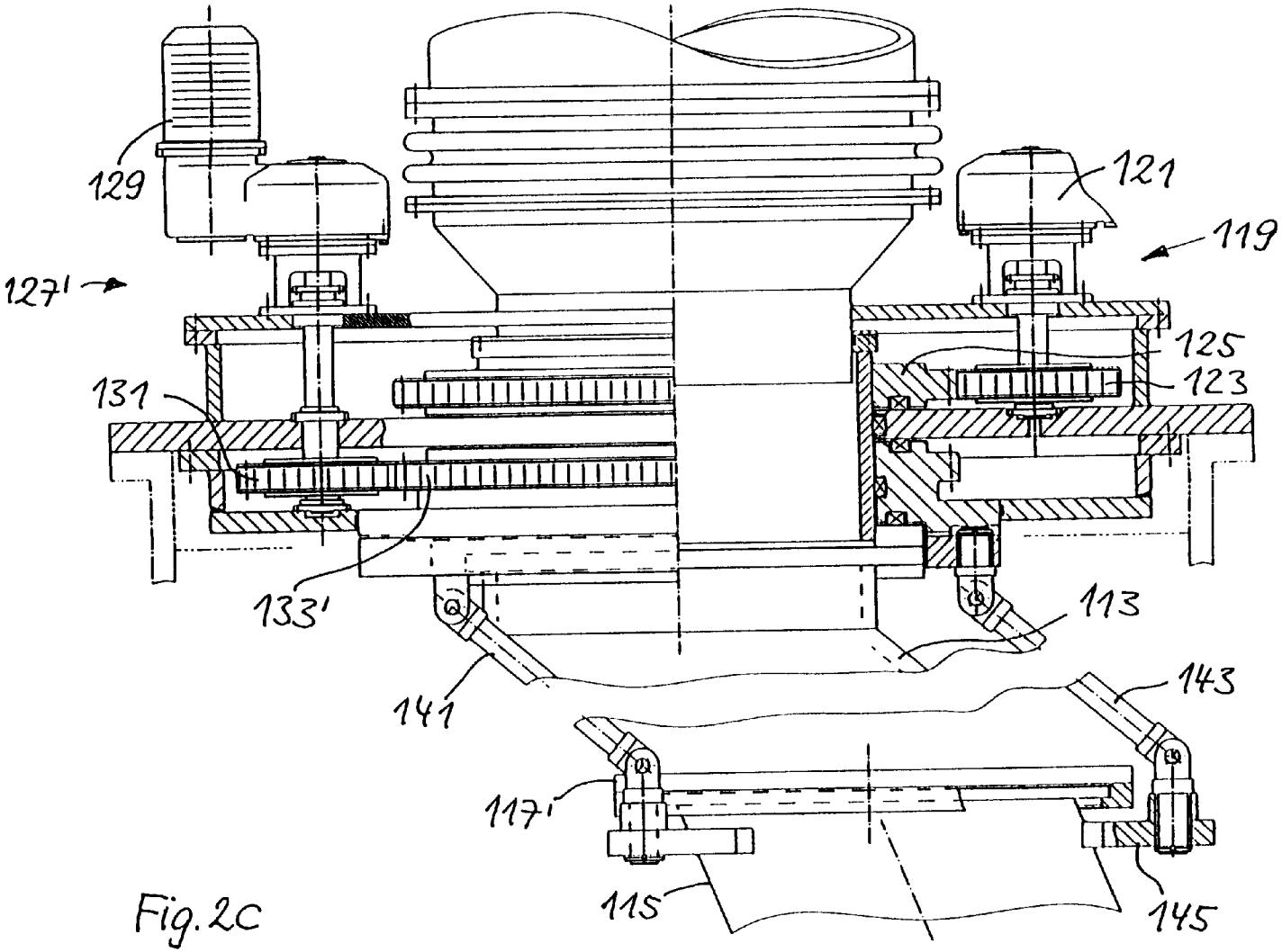

In FIGS. 2*a* to 2*c* is shown a second embodiment 100' of a feed device, in which the drive mechanism has been modified in comparison to that of the first embodiment. The great majority of the components in this arrangement are the same as those shown in FIGS. 1*a* to 1*c,* and hence are identified by the same reference numerals and are not explained again in the following.

The substantial difference between the feed device 100' and that shown in FIGS. 1*a* to 1*c* resides in the modification of the drive mechanism 127' for the lower part 115 of the feed chute. This drive mechanism, like the drive mechanism 127 according to FIGS. 1*a* to 1*c*, comprises an electric motor 129, a driving pinion 131 connected thereto, and a toothed wheel rim 133 mounted so that it can rotate about the basic body 107, but the transmission of force into the interior of the blast furnace 100, to the lower part 115, is accomplished in another way. Here it is implemented by an arrangement of two connecting rods 141, 143, which are pivotably attached at the upper end to the underside of the toothed wheel 133 and at the lower end to holders 143 that are welded to the lower part 115. Because the pinion of the output shaft is eliminated, the bearing housing has a different form (without toothed wheel rim against the lower part 115) and hence is identified by the numeral 117'.

The way the connecting-rod arrangement 141, 143 functions can be clearly seen in FIG. 2*b*, which shows a section along the plane A—A in FIG. 2*a*. Here again (in analogy to FIG. 1*b*) two different positions of the upper part 113 of the feed chute are shown; however, here only one position of the lower part is shown for each position of the upper part. It should be understood that the opening of the lower part 115 can be rotated by 360° about the second axis A2, under the action of the motor 119 as mediated by the connecting rods 143, 145, in each case—i.e., regardless of the position of the upper part 113.

Figure 3:
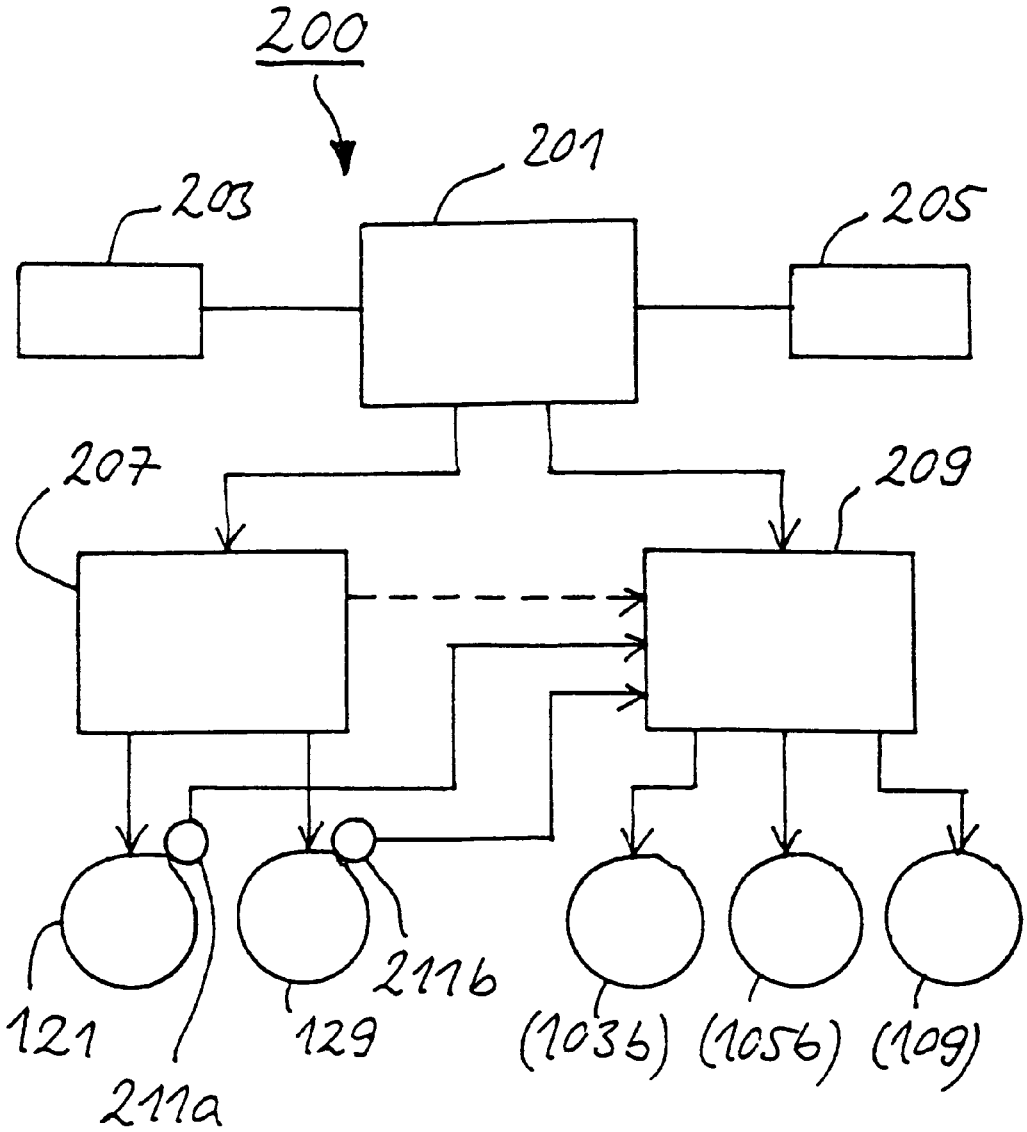
FIG. 3 is a block diagram to show how the feed device is controlled according to one exemplary embodiment.

In FIG. 3 a block diagram illustrates roughly how a feed device according to the first or the second embodiment explained above is controlled.

A control arrangement 200 comprises a process computer 201 with associated working memory 203 and program register 205, by means of which control of an entire blast-furnace process is performed, with reference to previously stored data sets and program sequences as well as to the signals from parameter sensors (not shown) at a blast furnace 101 (see preceding figures). The output from the process computer 201 is sent to a drive-mechanism control unit 207 and a feed control unit 209.

The drive-mechanism control unit 207 controls the motors 121, 129 in such a way that they move the upper and lower parts, respectively, of the feed chute so that the opening of the chute is correctly positioned with respect to the cross section of the blast furnace. The upper and lower parts are each provided with an angle indicator 211*a*, 211*b*; these detect the angular positions of the two parts and signal them to the feed control unit 209. Here the position signals are processed together with control signals from the process computer 201, to provide signals that drive the motors (not shown) that actuate the retaining flaps 103*b*, 105*b* and the gas-tight flap 109 so that feeding of the first and/or second material into the feed chute is controlled in dependence on the current position of the chute and the feed profile specified by the process computer. Instead of the signals from the angle indicators 211*a*, 211*b*, or in addition thereto, control signals (providing, e.g., information about the speed of rotation of the two drive mechanisms) can also be transmitted directly from the drive-mechanism control unit 207 to the feed control unit 209, as is indicated in the figure by a dashed arrow.

Figure 4A:
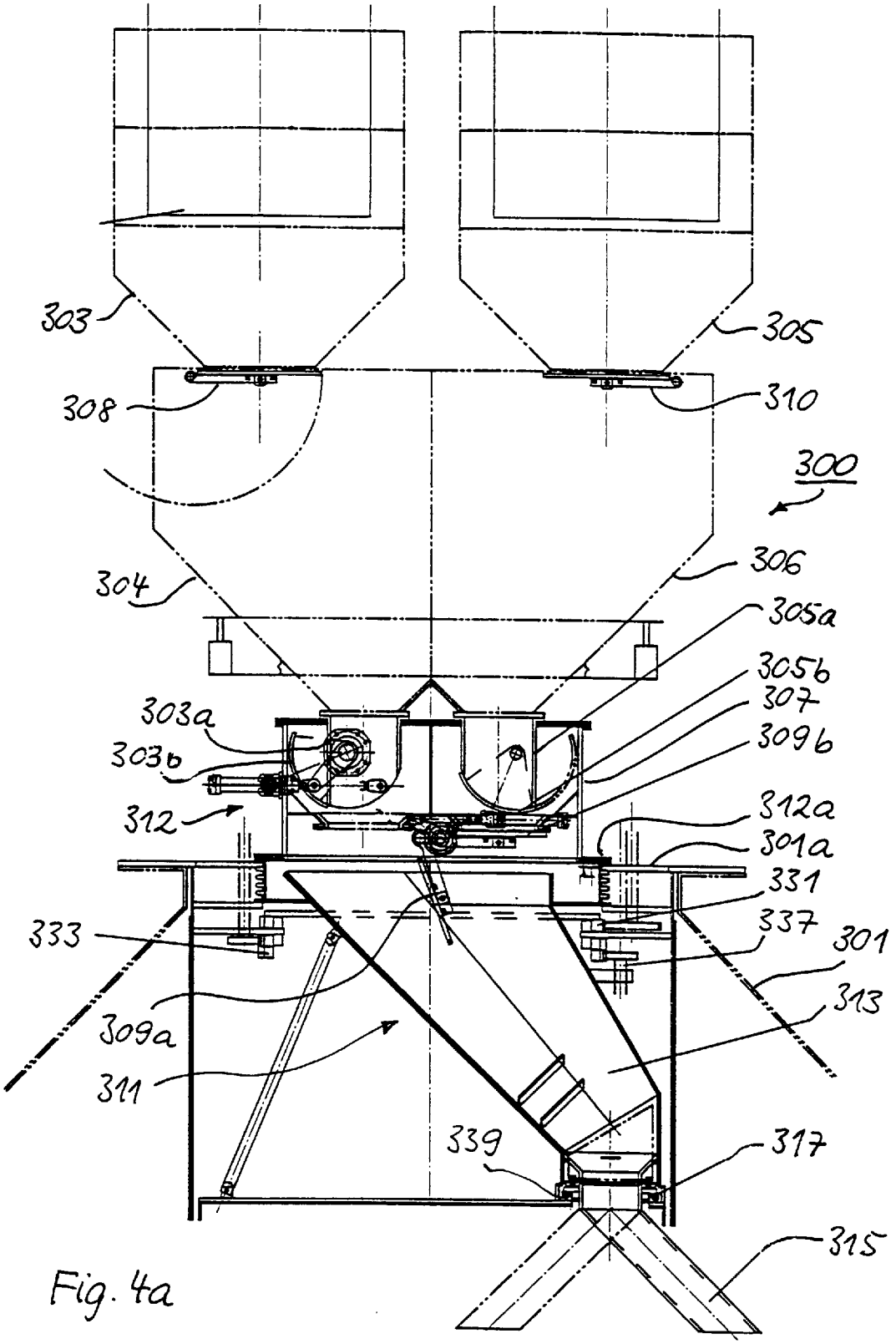
FIGS. 4*a,* 4*b* and 4*c* show a third embodiment of the feed device in accordance with the invention at a shaft furnace, in two diagrammatic forms, namely longitudinal sections along planes perpendicular to one another, as well as a simplified plan view of the shaft furnace.
Figure 4B:
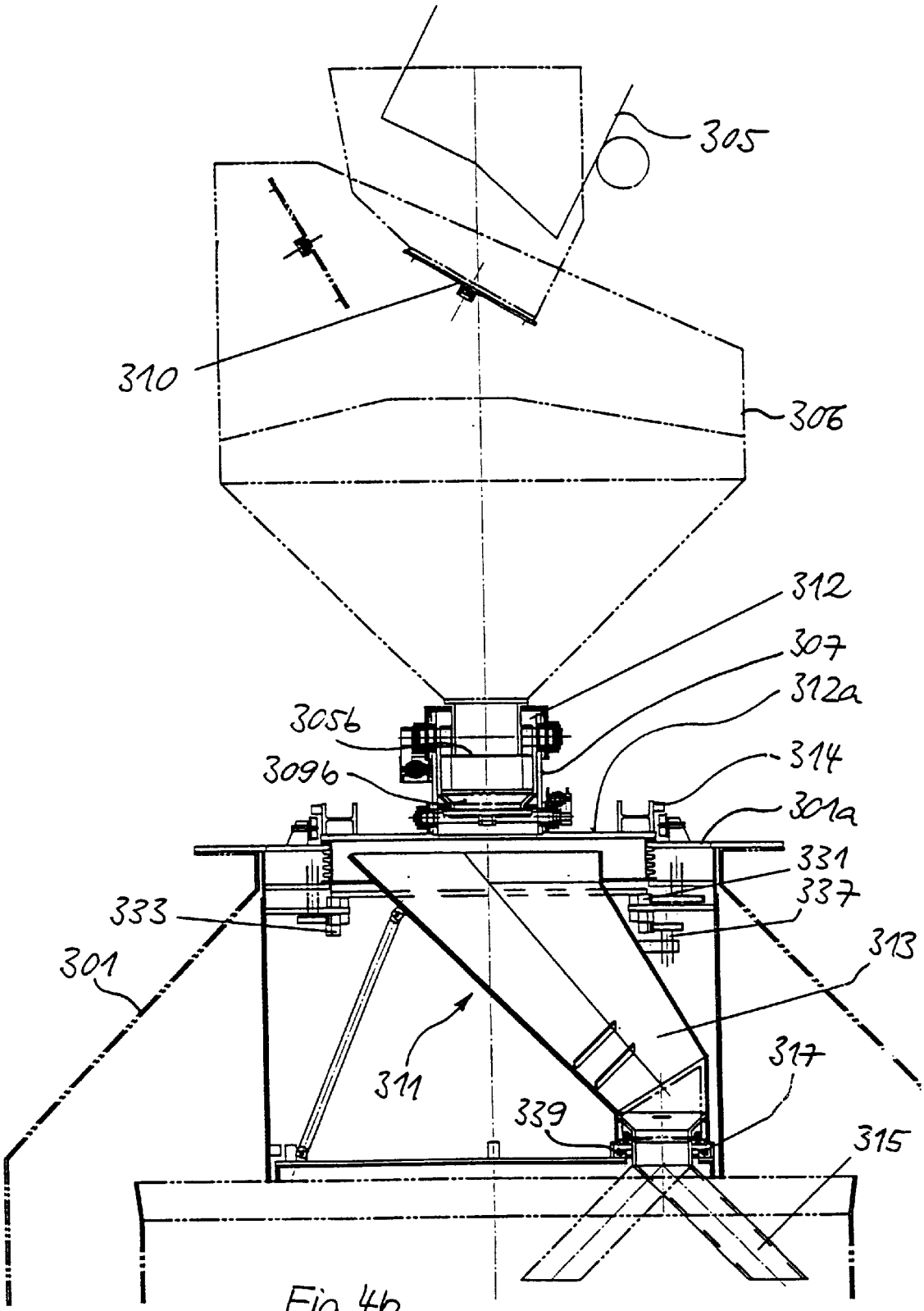
Figure 4C:
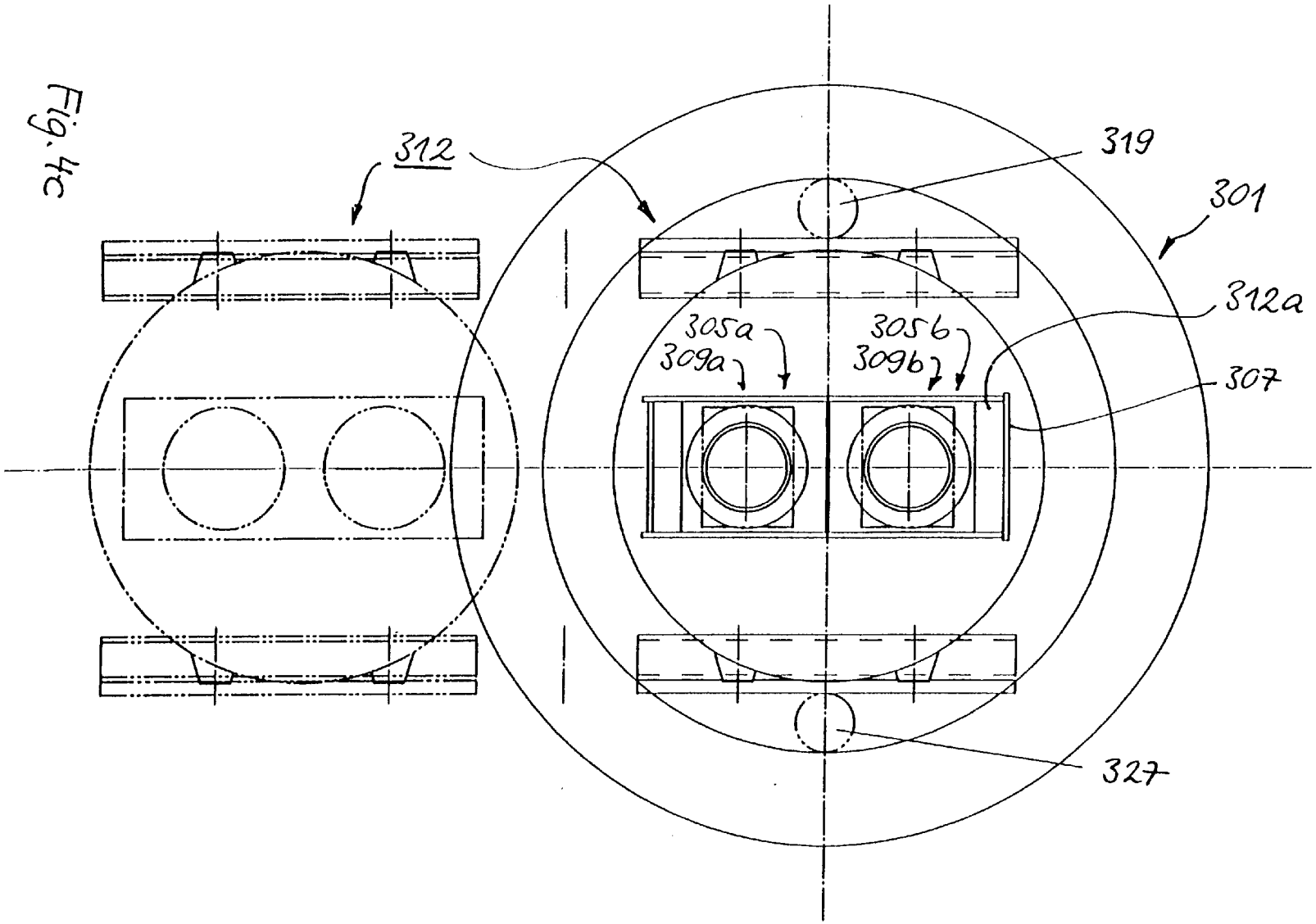

In FIGS. 4*a* to 4*c* another feed device 300 is sketched in simplified form. Each drawing shows in detail only a few of the elements essential to the design of the invention, and the following description is also concerned only with those that make clear the differences between this embodiment and the two preceding embodiments. Components that are the same as those in the embodiments according to FIGS. 1*a* to 1*c* and FIGS. 2*a* to 2*c* are not explained again in the following.

The feed device 300 serves to charge a blast furnace 301 with materials from a first and second reservoir 303, 305, in each case by way of a feed funnel 304, 306. At the outlet of each reservoir 303, 305, where the material passes into the associated feed funnel 304 or 306, a gas-tight hinged flap (shut-off valve) 308 or 310 is provided.

At each of the outlet tubes 303*a* and 305*a* of the funnels 304 and 306, respectively, is disposed a flow-control valve (a retaining flap) 303*b*, 305*b* with associated valve drive mechanism (not shown separately). Below this in the outlet region of each of the funnels 304, 306 is a gas-tight shut-off valve (flap) 309*a* or 309*b* with associated drive mechanism (again not shown separately).

The flaps or valves 305*a*, 305*b* and 309*a*, 309*b* together with their associated drive mechanisms are combined so as to form a compact valve assembly 312, which is displaceable as a whole on the upper surface of the blast furnace 301. A lower flange 312*a* of the valve assembly 312, which provides a planar seating of the latter on an upper flange 301*a* of the furnace 301, is sealed thereto by thermodynamic press-on elements so that reliable compensation for thermal expansion is ensured. By way of valve-assembly drivers 314 the valve assembly 312 can be displaced along the upper surface of the blast furnace 301, to facilitate maintenance work on, or replacement of, the valves and the parts of the feed chute to be described below. In FIG. 4*c* the valve assembly 312 is drawn with continuous lines in the position it occupies during use, above the blast furnace 301, and with dot-dot-dash lines in the displaced position, when it has been pushed to the side.

The structure of a feed chute 311, with an upper part 313 and a lower part 315 connected by a bearing housing 317 and with associated drive mechanisms, corresponds in principle to its structure in the first and second embodiments and hence is not described here in detail. The drive mechanisms (symbolically represented only in FIG. 4*c*) comprise electric-motor drive units 319 and 327, and the upper feed chute, i.e. its upper part 313, is driven directly by a gearwheel 331, whereas the lower part, i.e. the lower chute 315, is driven by way of a freely rotating doubly toothed wheel 333, an output shaft 337 and another gearwheel or pinion 339.

The invention can be put into practice not only by the exemplary embodiments described above, but rather in a large number of modifications that are within the competence of those skilled in the art.

List of reference numerals

100; 100'; 300 Feed device
101, 301 Blast furnace
103, 105; 303, 305 Reservoir
103*a*, 105*a* Outlet tube
103*b*, 105*b*; 303*b*, 305*b* Retaining flap (control valve for flow of material)
106; 304; 306 Feed funnel
107; 307 Basic body
107*a* Outlet
109; 309*a*, 309*b* Gas-tight flap (shut-off valve)
111; 311 Feed chute
113; 313 Upper part
115; 315 Lower part
117; 117'; 317 Bearing housing
119, 127; 127';
319, 327 Drive mechanism
121, 129 Electric motor
123, 131 Driving pinion
125, 133; 133' Toothed wheel rim
135, 139; 339 Pinion (gearwheel)
137; 337 Output shaft
140 Toothed wheel rim
141, 143 Connecting rod

145 Holder
200 Control arrangement
201 Process computer
203 Working memory
205 Program register
207 Drive-mechanism control unit
209 Feed control unit
211*a*, 211*b* Angle indicator
301*a* Flange (of furnace)
308, 310 Hinged flap (shut-off valve)
312 Valve assembly
312*a* Flange (of valve assembly)
314 Valve-assembly drive mechanism
331 Gearwheel
333 Doubly toothed wheel
A1 Long axis (first axis of rotation)
A2 Second axis of rotation

What is claimed is:

1. Feed device (100; 100'; 300) for loading materials into a shaft furnace (101; 301), from of at least one reservoir (103, 105; 303, 305), with a revolving chute (107, 111; 307, 311) comprising a cylindrical basic body (107; 307) that can be driven so as to rotate about a first, substantially vertically oriented axis of rotation (A1) with a first drive mechanism (119) and a feed chute (111; 311) that is fixedly attached to an outlet (107*a*) of the basic body and can be rotated therewith, characterized in that the feed chute is composed of an upper part (113; 313), which is adjacent to the outlet of the basic body and extends longitudinally at an angle to the first axis of rotation, and a lower part (115; 315), which is rotatably connected to the upper part and comprises a second drive mechanism (127; 127') for rotation about a second, substantially vertical axis of rotation (A2) spaced apart from the first axis of rotation.

2. Feed device according to claim 1, characterized in that the upper and lower parts (113, 115; 313, 315) are substantially cylindrical with circular or elliptical cross section and in particular have the same diameter or the same axis lengths, so that the feed chute (111; 311) as a whole is constructed as a two-part tube attached to the outlet at an angle.

3. Feed device according to claim 1, characterized in that the upper and lower parts (113, 115; 313,315) are connected to one another by a bearing housing 117; 117'; 317) at a plane through which the first and second axes of rotation pass substantially vertically.

4. Feed device according to claim 1, characterized in that the second drive mechanism (127) comprises a combination of pinion and toothed wheel rim (131, 133; 133') with a first toothed wheel rim (133; 133') that rotatably surrounds the outlet (107*a*) of the basic body (107).

5. Feed device according to claim 4, characterized in that there is connected to the toothed wheel rim (133') a connecting-rod arrangement (141, 143) that engages with the lower part (115) of the feed chute (111).

6. Feed device according to claim 4, characterized in that there is connected to the toothed wheel rim (133) an output shaft (137) that engages with the lower part (115) of the feed chute (111) and has at its end adjacent to the lower part a pinion (139) that engages with a second toothed wheel rim (140) that encloses the lower part in a non-rotatable manner.

7. Feed device according to claim 1, characterized in that the basic body (107) with the upper part (113) and in particular also the lower part (115) can be rotated through substantially 360°.

8. Feed device according to claim 1, characterized by at least one first and second reservoir (103, 105; 303, 305) for a first and a second material to be fed in, which can be brought into fluid communication with the basic body (107; 307) as desired in order to deliver the material.

9. Feed device according to claim 8, characterized by a feed control unit (209) to which are connected on the input side first and second angle indicators (211*a*, 211*b*) to detect the angle of rotation of the upper part (113) and the lower part (115), and on the output side flap drive mechanisms to produce or interrupt the fluid communication between the first and/or second reservoirs (103, 105) and the basic body (107).

10. Feed device according to claim 1, characterized by a drive-mechanism control unit (207) for the separate control of the first and second drive mechanisms (119, 127; 127') in synchrony or asynchronously with respect to one another.

11. Feed device according to claim 1, characterized in that between the reservoir or reservoirs (103, 105; 303, 305) there is provided a valve assembly (312) with at least one first valve (103*b*, 105*b*; 303*b*, 305*b*) to control the flow of material and one first gas tight shut-off valve (309; 309*a*, 309*b*).

12. Feed device according to claim 11, characterized in that between the reservoir or reservoirs (303, 305) and the valve assembly (312) there is provided one feed funnel (304, 306) for each reservoir, at the outlet of which is disposed the valve (303*b*, 305*b*) to control the flow of material.

13. Feed device according to claim 12, characterized in that at an outlet of the or each reservoir (303, 305) into the associated feed funnel (304, 306) there is disposed a second gas-tight shut-off valve (308, 310).

14. Feed device according to claim 11, characterized in that the valve assembly (312), with the valve or all valves (303*b*, 305*b*) to control the flow of material and the first shut-off valve or all first shut-off valves (309*a*, 309*b*) and the valve drive mechanisms associated with each of these, is constructed as a unit that can be displaced as a whole with respect to the shaft furnace (303, 305) and the reservoir or reservoirs.

15. Feed device according to claim 11, characterized in that an inlet flange (301*a*) of the shaft furnace (301) is sealed with respect to a flange (312*a*) of the valve assembly (312), in particular by way of a press on means that compensates for thermal expansion.

16. Feed device according to claim 15, characterized in that the press-on means comprises a hydraulic press-on device or thermostatic press-on elements.

* * * * *